US006851595B1

(12) United States Patent
Lee

(10) Patent No.: US 6,851,595 B1
(45) Date of Patent: Feb. 8, 2005

(54) NAIL BEATING DEPTH ADJUSTER

(76) Inventor: Yun-Chung Lee, 235 Chung-Ho, Box 8-24, Taipei (TW)

( * ) Notice: Subject to any disclaimer, the term of this patent is extended or adjusted under 35 U.S.C. 154(b) by 0 days.

(21) Appl. No.: 10/746,689

(22) Filed: Dec. 29, 2003

(51) Int. Cl.[7] ..... B25C 1/04
(52) U.S. Cl. ..... 227/142; 227/8
(58) Field of Search ..... 227/8, 130, 142

(56) References Cited

U.S. PATENT DOCUMENTS 5,261,587 A * 11/1993 Robinson ..... 227/8
5,385,286 A * 1/1995 Johnson, Jr. ..... 227/8
6,024,267 A * 2/2000 Chen ..... 227/8
6,145,727 A * 11/2000 Mukoyama et al. ..... 227/130
6,557,745 B2 * 5/2003 Wang ..... 227/142
6,581,815 B1 * 6/2003 Ho et al. ..... 227/142
6,763,992 B2 * 7/2004 Hirai ..... 227/142

* cited by examiner

*Primary Examiner*—Scott A. Smith

(57) ABSTRACT

A nail beating depth adjuster of a nail driver comprises a limiting cover, a first and a second spring, and a nut. The limiting cover is extended with a first seat and a second seat which are coaxial. A linkage passes through the holes in the first seat and second seat. A first spring encloses the linkage between the first seat and second seat. A nut encloses an outer thread of the linkage between the first seat and second seat. The first spring resists against the nut. The nut is formed with a plurality of buckling recesses which are spaced with an equal space. One of the end surfaces of first seat and second seat is formed with at least one tooth. Thereby, by the first spring pressing against the nut, the buckling recesses on the nut expands upon or engages with the tooth for adjusting and positioning.

4 Claims, 6 Drawing Sheets

NAIL BEATING DEPTH ADJUSTER

FIELD OF THE INVENTION

The present invention relates to nail drivers, and particularly to a nail beating depth adjuster of a nail driver for adjusting the beating depth of a nail, wherein a spring and a linkage are installed on a linkage for controlling a limiting cover to adjust the beating depth.

BACKGROUND OF THE INVENTION

In one prior art about the nail beating depth adjuster discloses a limiting cover (or called as adjusting sheets). One end of the cover has an adjusting rod. An elastic sheet, a threaded cover, and a nut are installed on the adjusting rod. The adjusting rod is locked to a driven sheet for inducting the nail to be beaten. Thereby, by rotating the threaded cover, the adjusting rod is adjusted and the limiting cover moves for controlling the beating length of the nail. Thereby, no any hand tool is necessary. The beating length can be adjusted rapidly.

It is known that the prior art threaded cover is practically a nut for controlling the beating depth. Although the cover can adjust the displacement of the cover along the threads of the adjusting rod (namely adjusting the beating depth), and control the positioning by the buckling of an elastic sheet and the thread. The strong vibration force as triggering the nail by the nail driver, the elastic sheet can not effectively control the positioning of the threaded cover along the threads. Thus, the positioning of the nail after adjusting the beating depth of the limiting cover is not as good as desired. Furthermore, the structure is too complicated to be used easily and made with a lower cost.

SUMMARY OF THE INVENTION

Accordingly, the primary object of the present invention is to provide a nail beating depth adjuster having a nut for improving the control of the beating depth so that the beating depth can be controlled stably and precisely.

To achieve above object, the present invention provides a nail beating depth adjuster of a nail driver which comprises a limiting cover, a first and a second spring, and a nut. The limiting cover is extended with a first seat and a second seat which are coaxial. A linkage passes through the holes in the first seat and second seat. A first spring encloses the linkage between the first seat and second seat. A nut encloses an outer thread of the linkage between the first seat and second seat. The first spring resists against the nut. The nut is formed with a plurality of buckling recesses which are spaced with an equal space. One of the end surfaces of first seat and second seat is formed with at least one tooth. Thereby, by the first spring pressing against the nut, the buckling recesses on the nut expands upon or engages with the tooth for adjusting and positioning.

Moreover, a sliding groove is formed in the nut for receiving the first spring. A distal end of the outer thread of the linkage is a trench for embedding a screw opener. A distal end of the outer thread is screwed with an inner threaded cover and the inner threaded cover is received within the second hole. The inner threaded cover is formed with a recess for embedding a screw opener.

The various objects and advantages of the present invention will be more readily understood from the following detailed description when read in conjunction with the appended drawing.

DETAILED DESCRIPTION OF THE PREFERRED EMBODIMENTS

Figure 1:
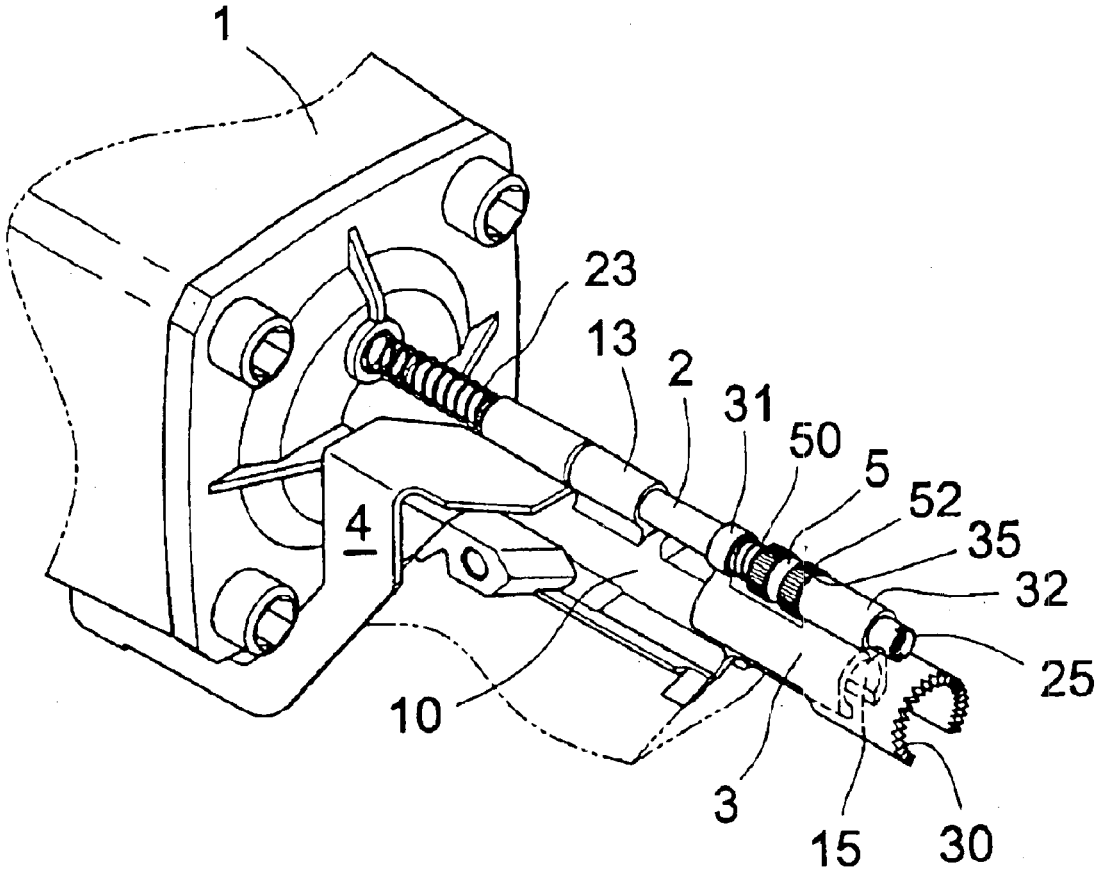
FIG. 1 is a perspective view showing the nail beating depth adjuster of the present invention, which is assembled to the periphery of the guide tube at the lower end of a nail driver head.

Referring to FIG. 1, it is illustrated that the nail beating depth adjuster of the present invention is installed at a periphery of a guide tube 10 at a lower end of the nail driver head 1.

Figure 5:
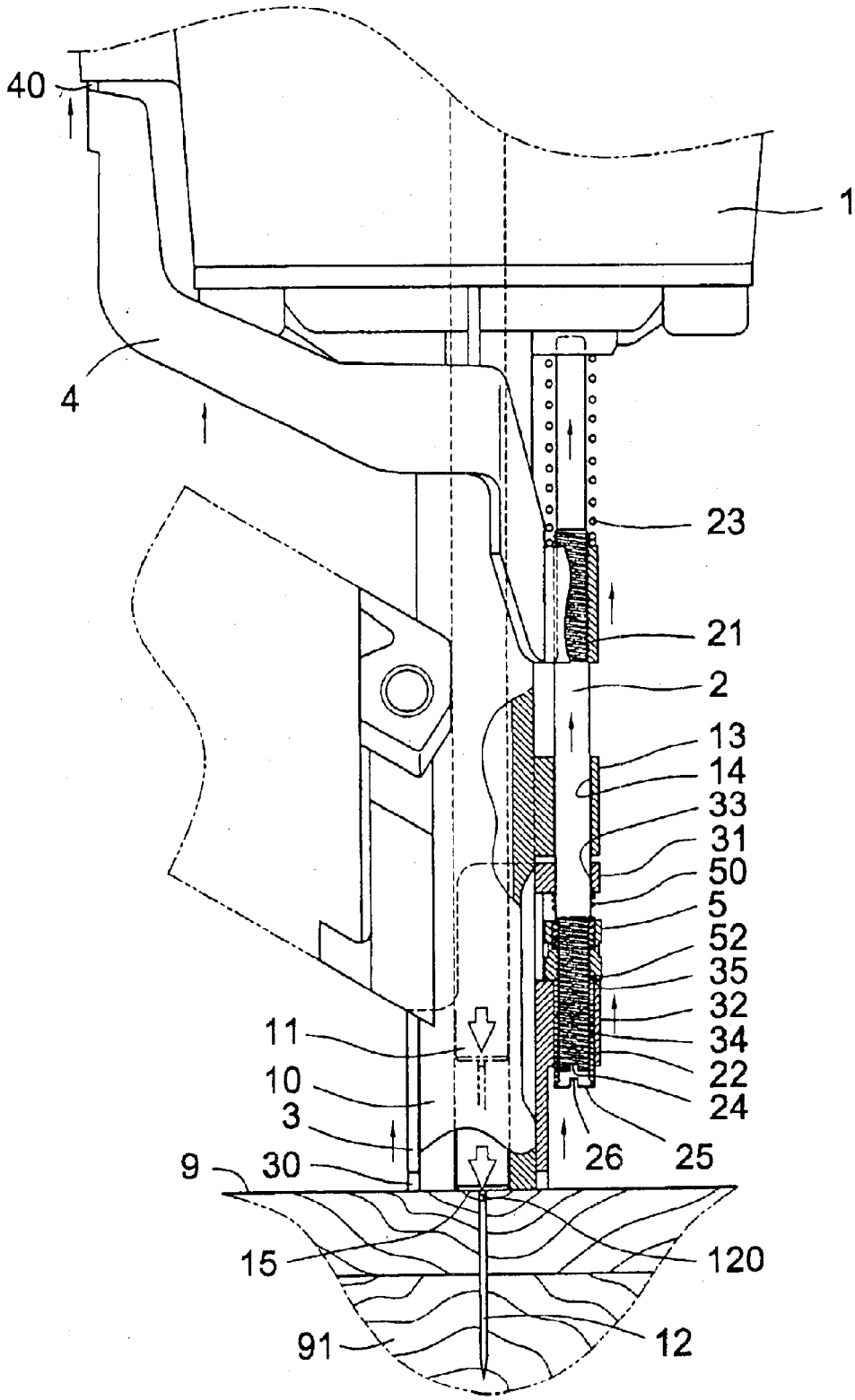
FIG. 5 is a cross section view showing the nail is beaten before the adjustment of the beating depth so that the nail head embeds into the surface of the work piece.

A nail beating rod 11 is installed in the guide tube 10 (referring to FIG. 3) for beating nails 12 in the guide tube 10 one by one so that the nails are beaten into the work piece 9 and 91 (referring to FIG. 5).

Figure 2:
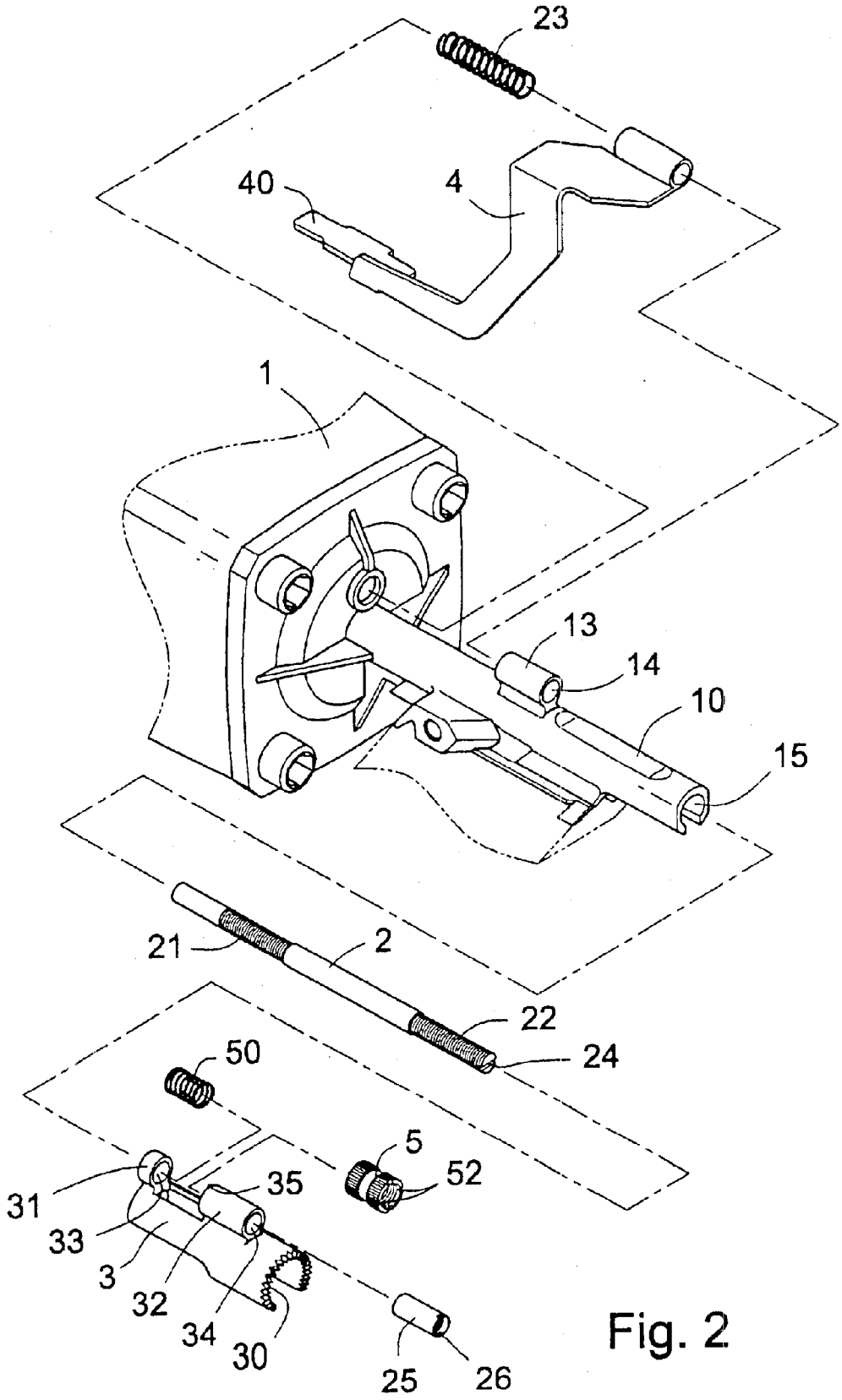
FIG. 2 is an exploded view showing the components of the nail beating depth adjuster of the present invention.

The end portion of the guide tube 10 is extended with a retaining seat 13 (referring to FIG. 2). The retaining seat 13 has a central hole 14 for pivotally engaging with a linkage 2 (referring to FIG. 3). Furthermore, an outer wall of the guide tube 10 near the nail outlet 15 is movably installed with a limiting cover 3.

The linkage 2 is movably received into the seat hole 14 of the retaining seat 13 (referring to FIG. 2). The rod body of the linkage 2 inserted into the seat hole 14 is formed with locking thread 21 for locking a driven rod 4 (referring to FIG. 3), or the linkage 2 can be tightly engaged to, or welded to or glued to the driven rod 4 so that the driven rod 4 is driven by the linkage 2 so that the two moves synchronously.

After the linkage 2 is fixed to the driven rod 4, a second spring 23 is attached to the rod body of the linkage 2 so as to resist against a bottom of the driver head 1 (referring to FIG. 3) so that when the linkage 2 synchronously moves with the driven rod 4, they can restore to the original position.

The driven rod 4 is made as a bending plate. One end of the driven rod 4 is fixed to the linkage 2 and another end thereof is made as a push sheet 40 which is embedded into a place near the trigger of the nail driver. When the linkage 2 drives the driven rod 4, the push sheet 40 of the driven rod 4 pushes the safety catch of the trigger to induce the operation of beating the nail.

Figure 3:
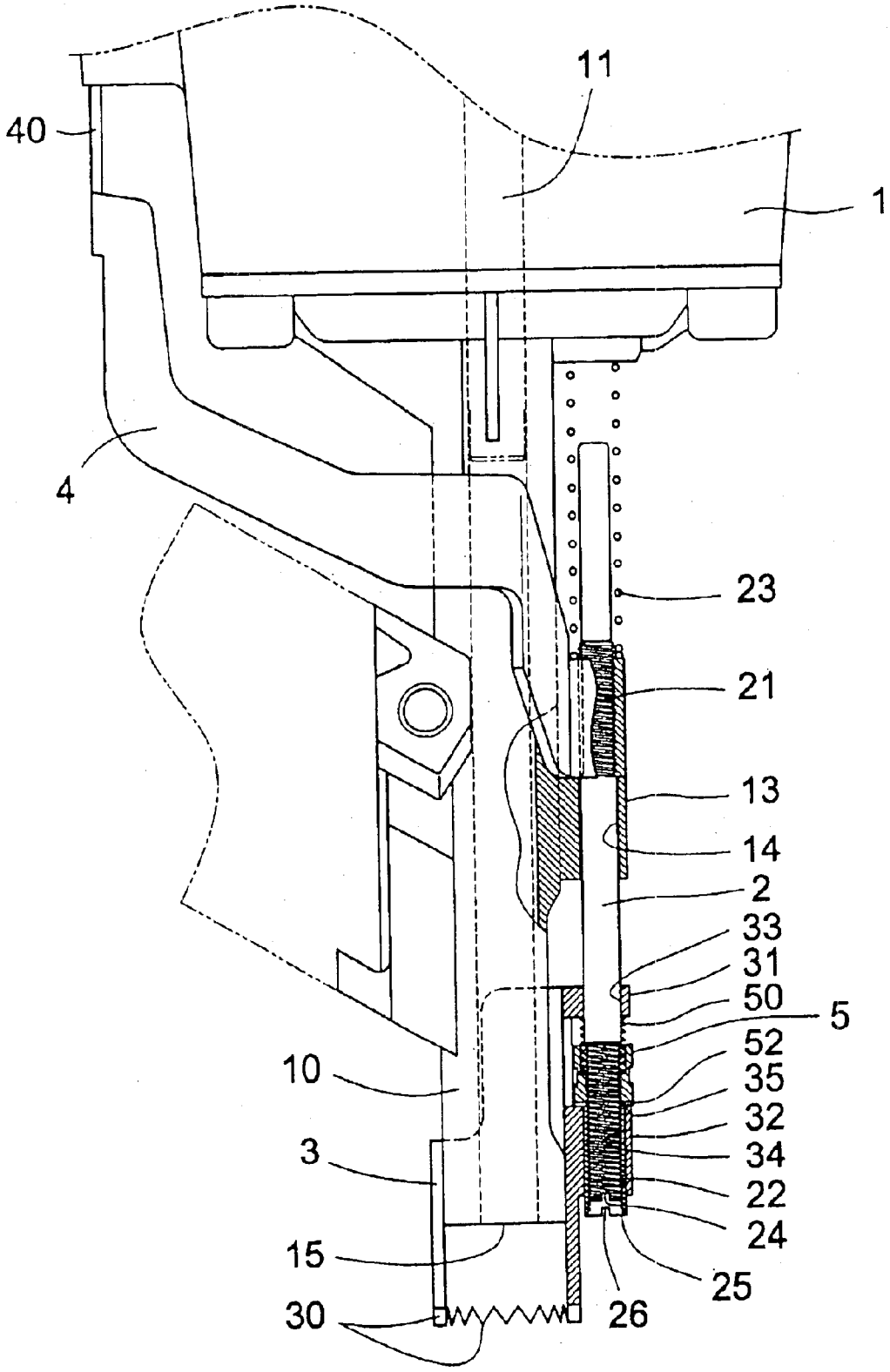
FIG. 3 is a cross section view of the present invention, where the assembly of the nail beating depth adjuster of the present invention is illustrated.

An outer thread 22 extending to the distal end thereof is formed on the rod body of the linkage 2 (referring to FIG. 2) for engaging the limiting cover 3, a first spring 50 on the seat and a nut 5 for adjusting the beating depth of the nail (referring to FIG. 3).

Figure 4:
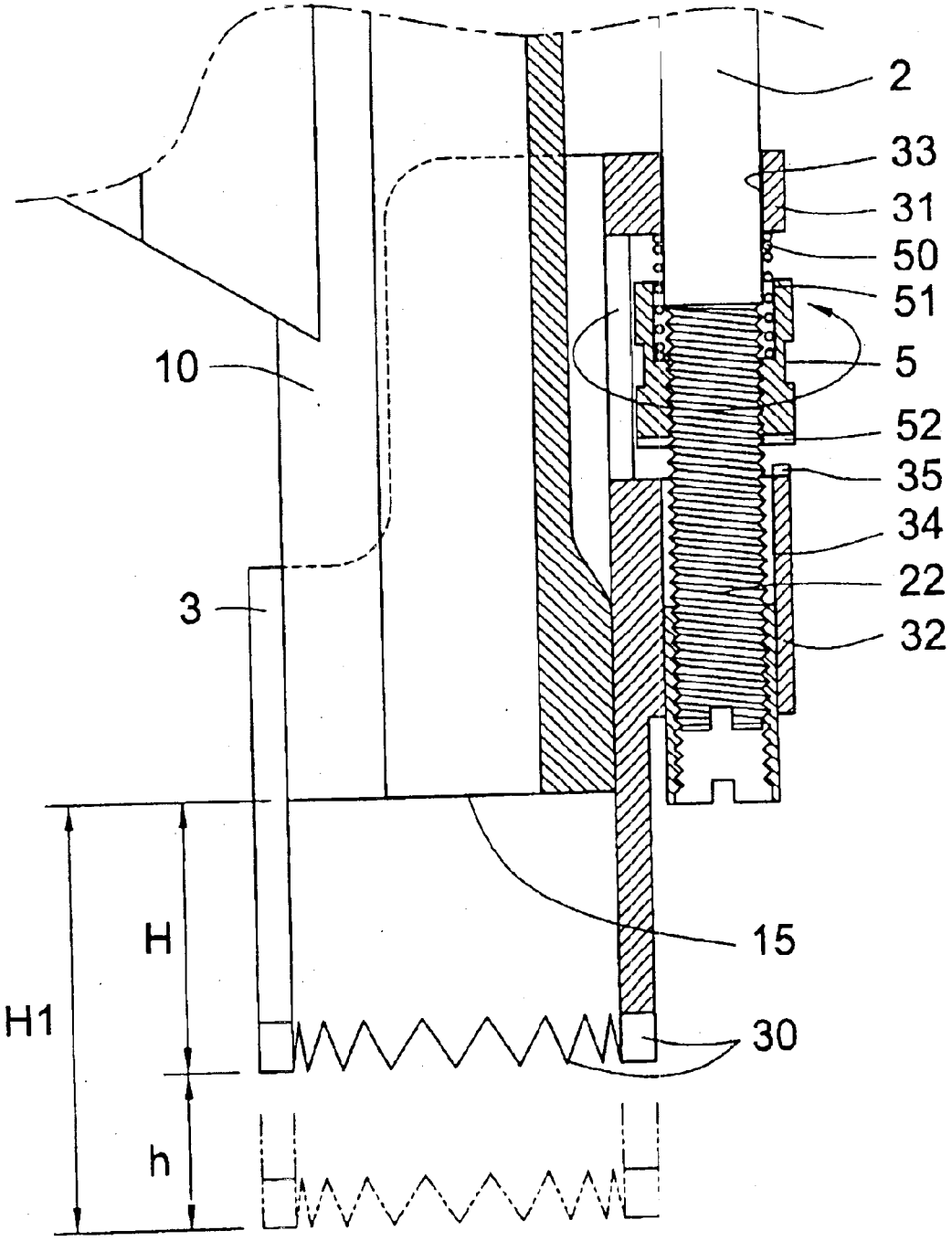
FIG. 4 is a partial enlarged view of the present invention, where the nut is screwed to control the beating depth by a limiting cover.

The limiting cover 3 is a C shape tube (referring to FIG. 2) and is movably installed to the guide tube 10 near the outer wall of the nail outlet 15 (referring to FIG. 3). One side of the limiting cover 3 is formed with a press 30 which is formed by a plurality of teeth for pressing a surface of the work piece 9 (referring to FIG. 5). Another end of the limiting cover 3 is extended with a first seat 31 and a second seat 32 (referring to FIG. 2). A first hole 33 is formed on the first seat 31 and a second hole 34 is formed on the second seat 32. The first seat 31 and the second seat 32 are coaxial. The linkage 2 passes through the first hole 33 and second hole 34 (referring to FIG. 3). Moreover, the first spring 50 encloses upon the outer thread 22 of the linkage 2 between the first hole 33 and second hole 34 so that the first spring 50 resists against the nut 5 by the resilient force of the first spring 50 (referring to FIG. 4). A spring trench 51 can be formed in the nut 5 for receiving the first spring 50.

An annular surface of the nut 5 is formed with a plurality of buckling recesses 52 which are spaced with an equal space (referring to FIG. 2). One end surface of the seat portion 32 is formed with at least one tooth 35 at a position corresponding to one of the buckling recesses 52. Thereby, by the first spring 50 pressing against the nut 5, the buckling recesses 52 on the nut 5 expands elastically upon or engages with the tooth 35 for adjusting and positioning.

By above said components, the user can push or pull the nut 5, the buckling recesses 52 of the nut 5 will separate from the tooth 35 (referring to FIG. 4), and the nut 5 is moved along the outer thread 22 of the linkage 2. After adjusting the nut 5, the nut 5 is released. By the first spring 50 presses against the nut 5, the buckling recesses 52 of the nut 5 will engage with the tooth 35 so that the nut 5 is strongly positioned (referring to FIG. 3). Especially, when the nail triggers one nail so as to generate a larger vibration, the nut 5 will not release or displace.

Moreover, since the nut 5 is confined between the first seat 31 and the second seat 32 of the limiting cover 3, and the linkage 2 is motionless before touching the work surface, when adjusting the position of the nut 5, the limiting cover 3 is guided to move with the same extent. For example, a gap between the press 30 of the limiting cover 3 in FIG. 4 and the nail outlet 15 of the guide tube 10 is H. When the nut 5 is adjusted so that the nut 5 guides the first seat 31 and second seat 32 of the limiting cover 3 along the outer thread 22. Thereby, the limiting cover 3 will move synchronously with an extent of h. Thereby, gap from the lower end of the press 30 to the lower end of the nail outlet 15 is H1. The H1 equals H +h or H− h so that the nut 5 has the ability for adjusting (increasing or decreasing) the beating length of the nail.

Figure 6:
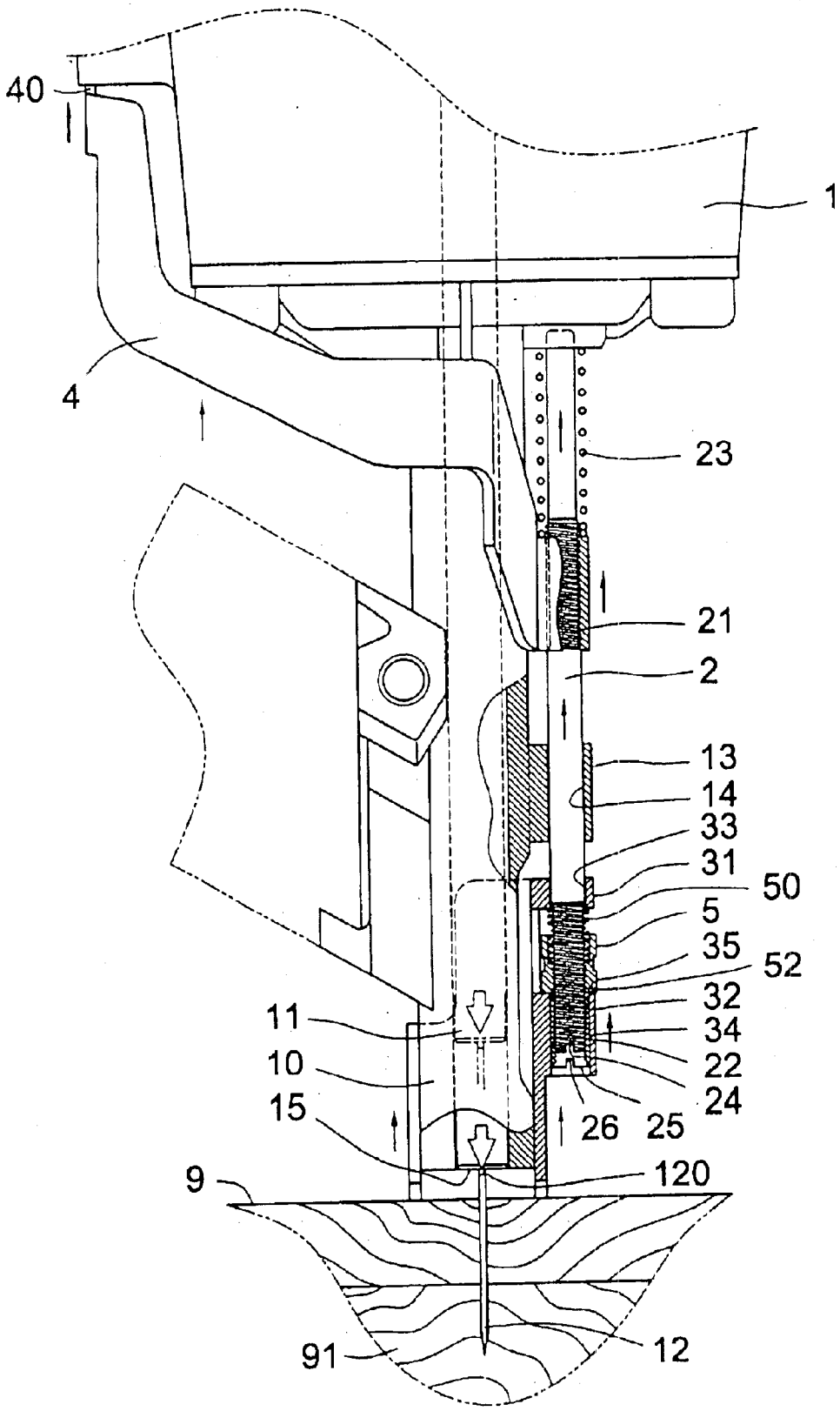
FIG. 6 is a cross section view showing that after adjusting the beating length, the nail head protrudes from the surface of the work piece.

The adjusting of the beating depth of the limiting cover 3 is to control the distance between the nail beating rod 11 in the guide tube 10 and the lower end of the limiting cover 3 when the nail is beaten. For example, when the distance from the lower end of the press 30 to the lower end of the nail outlet 15 is H (referring to FIG. 4), the nail beating depth of the limiting cover 3 is not adjusted. The user firstly press the limiting cover 3 to a surface of the work piece 9 for driving the linkage 2 to extend upwards to resist against the bottom portion of the nail driver head 1 (referring to FIG. 5). At this moment, the trigger (not shown) is triggered, the nail beating rod 11 will beat the whole nail 12 including the nail head 120 into the work piece 9 (referring to FIG. 5). Thus, the operator of the nail driver is difficult to pull the nail head 120 which is completely embedded into the work piece 9 and thus the whole nail 12 is difficult to be pulled out. In other words, when the user adjusts the beating depth by the nut 5, for example, when the gap from the lower end of the press 30 to the lower end of the nail outlet 15 is adjusted to H1 (referring to FIG. 4) and the user has pressed the limiting cover 3 against the surface of the work piece 9 and the nail 12 is beaten (referring to FIG. 6), since the limiting cover 3 has moved downwards so as to increase the distance to the nail outlet 15. Thereby, the nail beating rod 11 can not beat the whole nail 12 into the work piece 9. Thereby, the nail head 120 protrudes from a surface of the work piece 9 and thus the nail head 120 is not embedded into the work piece 9 (referring to FIG. 6). Thereby, the operator can pull the whole nail 12 from the work pieces 9 and 91.

However, the buckling recesses elastically expands from or engages to the tooth, thereby the extent of the driven rod in the thread of the linkage is controlled by the scale of the driven rod. By assembling of the buckling recesses 52 and the tooth 35, the movement of the nut 5 can be controlled precisely so as to prevent the nut 5 from releasing.

Moreover, a distal end of the outer thread 22 of the linkage 2 is formed with a groove 24 for embedding a screw opener (referring to FIG. 2), a distal end of the outer thread 22 is screwed with an inner threaded cover 25 and the inner threaded cover 25 is received within the second hole 34. The inner threaded cover 25 is formed with grooves 26 for embedding a screw opener. By assembling the inner threaded cover 25, the screw opener can adjust the position of the linkage 2 and adjust the traveling length of the outer thread 22 for controlling the beating length.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A nail beating depth adjuster of a nail driver comprising a guide tube;

a retaining seat extending from a lateral side of the guide tube; the retaining seat having a central seat hole for movably installing a linkage;

an outer wall of the guide tube near a nail outlet being installed with a limiting cover; a driven rod being installed with the linkage; one end of the driven rod being embedded to a position near a trigger of the nail driver for triggering an operation to beating a nail; a rod body of the linkage being installed with a second spring which resists against a bottom of the nail driver head; and an outer thread being formed on the rod body of the linkage; wherein one side of the limiting cover is extended with a first seat and a second seat; a first hole is formed in the first seat and a second hole is formed in the second seat; the first hole and second hole are coaxial and the linkage passes through the first hole and second hole;

a first spring encloses the linkage between the first seat and second seat; a nut encloses an outer thread of the linkage between the first seat and second seat; the first spring resisting against the nut; and an annular end surface of the nut is formed with a plurality of buckling recesses which are spaced with an equal space; one of the end surfaces of first seat and second seat is formed with at least one tooth at a position corresponding to one of the buckling recesses; thereby, by the first spring pressing against the nut, the buckling recesses on the nut expands elastically upon or engages with the tooth for adjusting and positioning.

2. The nail beating depth adjuster of a nail driver as claimed in claim 1, wherein a sliding groove is formed in the nut for receiving the first spring.

3. The nail beating depth adjuster of a nail driver as claimed in claim 1, wherein a distal end of the outer thread of the linkage is a trench for embedding a screw opener.

4. The nail beating depth adjuster of a nail driver as claimed in claim 1, wherein a distal end of the outer thread is screwed with an inner threaded cover and the inner threaded cover is received within the second hole; the inner threaded cover is formed with a recess for embedding a screw opener.

* * * * *